US006655764B2

(12) United States Patent
Sormunen et al.

(10) Patent No.: US 6,655,764 B2
(45) Date of Patent: Dec. 2, 2003

(54) METHOD OF MANUFACTURING A COVER FOR COMMUNICATION DEVICES

(75) Inventors: Juha Sormunen, Sauvo (FI); Eero Maki-Tulokas, Mary nummi (FI); Tomi Kanninen, Salo (FI); Pekka Hakanen, Raisio (FI)

(73) Assignee: Nokia Mobile Phones Limited, Espoo (FI)

( * ) Notice: Subject to any disclaimer, the term of this patent is extended or adjusted under 35 U.S.C. 154(b) by 38 days.

(21) Appl. No.: 09/867,916

(22) Filed: May 30, 2001

(65) Prior Publication Data

US 2002/0101140 A1 Aug. 1, 2002

Related U.S. Application Data

(60) Provisional application No. 60/265,838, filed on Feb. 1, 2001.

(51) Int. Cl.[7] ..... A47B 97/00

(52) U.S. Cl. ..... 312/352; 72/379.4

(58) Field of Search ..... 312/223.1, 223.2, 312/352, 257.1; 72/379.4, 379.2, 347, 349

(56) References Cited

U.S. PATENT DOCUMENTS

| | | | | | |
|---|---|---|---|---|---|
| 3,698,337 | A | * | 10/1972 | Brawner et al. | 72/379.4 |
| 5,168,742 | A | * | 12/1992 | Heyes et al. | 72/379.4 |
| 5,487,295 | A | * | 1/1996 | Diekhoff et al. | 72/379.4 |
| 5,572,893 | A | * | 11/1996 | Goda et al. | 72/254 |
| 5,749,258 | A | * | 5/1998 | Werth | 72/347 X |
| 6,074,779 | A | * | 6/2000 | Austin et al. | 429/100 |

FOREIGN PATENT DOCUMENTS

| | | | |
|---|---|---|---|
| DE | 4133340 | * | 4/1993 |
| GB | 2 331 888 | | 6/1999 |
| JP | 2000-176588 | | 6/2000 |

* cited by examiner

*Primary Examiner*—James O. Hansen
(74) *Attorney, Agent, or Firm*—Perman & Green, LLP

(57) ABSTRACT

A housing or decorative cover for a mobile communication device is constructed by impact extrusion of metal. The impact extrusion die and punch are designed to provide attachment ridges and slots for ease of assembling the cover to the device. To provide a final shape and finish the impact extruded metal cover is drawn through a drawing stone.

6 Claims, 4 Drawing Sheets

METHOD OF MANUFACTURING A COVER FOR COMMUNICATION DEVICES

This provisional application claims benefit of application No. 60/265,838 filed on Feb. 1, 2001.

BACKGROUND OF THE INVENTION

Mobile communications devices are rapidly becoming the preferred instrument for mass communications. With the resulting demand, a need has arisen for improved methods of manufacturing these devices. In particular the housings for these devices must be manufactured with greater efficiency while affording greater impact resistance at a lower cost.

Impact extrusion is a well established method of manufacture which allows the cold forming of metal parts into a wide variety of shapes. In this process a wide variety of shapes can be formed in a fast, simple and repeatable manner. Impact extrusion involves the placement of a slug of metal into a die and forcing a punch into the die. The metal slug is rendered plastic by the impact and flows around the periphery of the punch. A part results which has an external shape in the form of the die and an internal shape in the form of the punch. It has been found that this method works with a variety of metals, for example, aluminum, zinc, gold, steel, magnesium, titanium, copper, and an assortment of alloys. Aluminum is generally preferred.

It is a purpose of this invention to employ impact extrusion to manufacture the housings for mobile communications devices. This would replace the present production methods which involve coining/pressing mating halves of a housing. One method in use constructs the mating housing parts by means of deep drawing. In this method the halves are formed, aligned and joined together by laser welding. The parts often are distorted by spring back. The edges of the parts need to be trimmed to size causing scratching of the finish. This requires further finishing by plasting or other means which adds to the risk of distortion. This makes the joining process difficult and after joining, extensive finishing is required to hide the weld lines and the resulting marking of the finish, i.e. by blasting and polishing. It is a purpose of this invention to provide a more economical process for constructing these parts.

SUMMARY OF THE INVENTION

A method is performed in which a housing for a mobile communications device is constructed. The steps include constructing a slug of metal selected from aluminum or appropriate alloy. Placing the slug for further processing in a reverse impact extrusion die. Constructing the die having a generally rectangular cross section. Constructing a punch with a shape which is matched to fit into the die with a predetermined clearance. Impacting the slug to cause the slug to become plastic and flow around the punch to fill the clearance. Thereby forming a single piece housing having a thickness consistent with the clearance. The impact extruded housing is then cold worked in an ironing step to form the housing with a final shape and finish. The die is constructed with grooves or rails to provide an attachment mechanism for side grip panels.

DESCRIPTION OF THE DRAWING

The subject invention is described in more detail below with reference to the drawing in which.

DETAILED DESCRIPTION OF THE INVENTION

Mobile communication devices require housings that protect the internal communication system of the device and allow for the mounting and assembly of the system. Such systems generally include a printed circuit board and related externally exposed interface devices such as displays switches and buttons. To accommodate these requirements, the housings have been constructed by deep drawing the housing halves which are aligned and welded together after assembly of the components. This construction requires finish steps to cover the joint and weld residue. Components manufactured in this manner have difficulty in achieving tolerances. This increases the incidence of scrapping for quality control. The process of this invention extrudes the housing from a metal material in one step, resulting in a one piece, near finished housing with a savings in time, scrap and processing.

Figure 3:
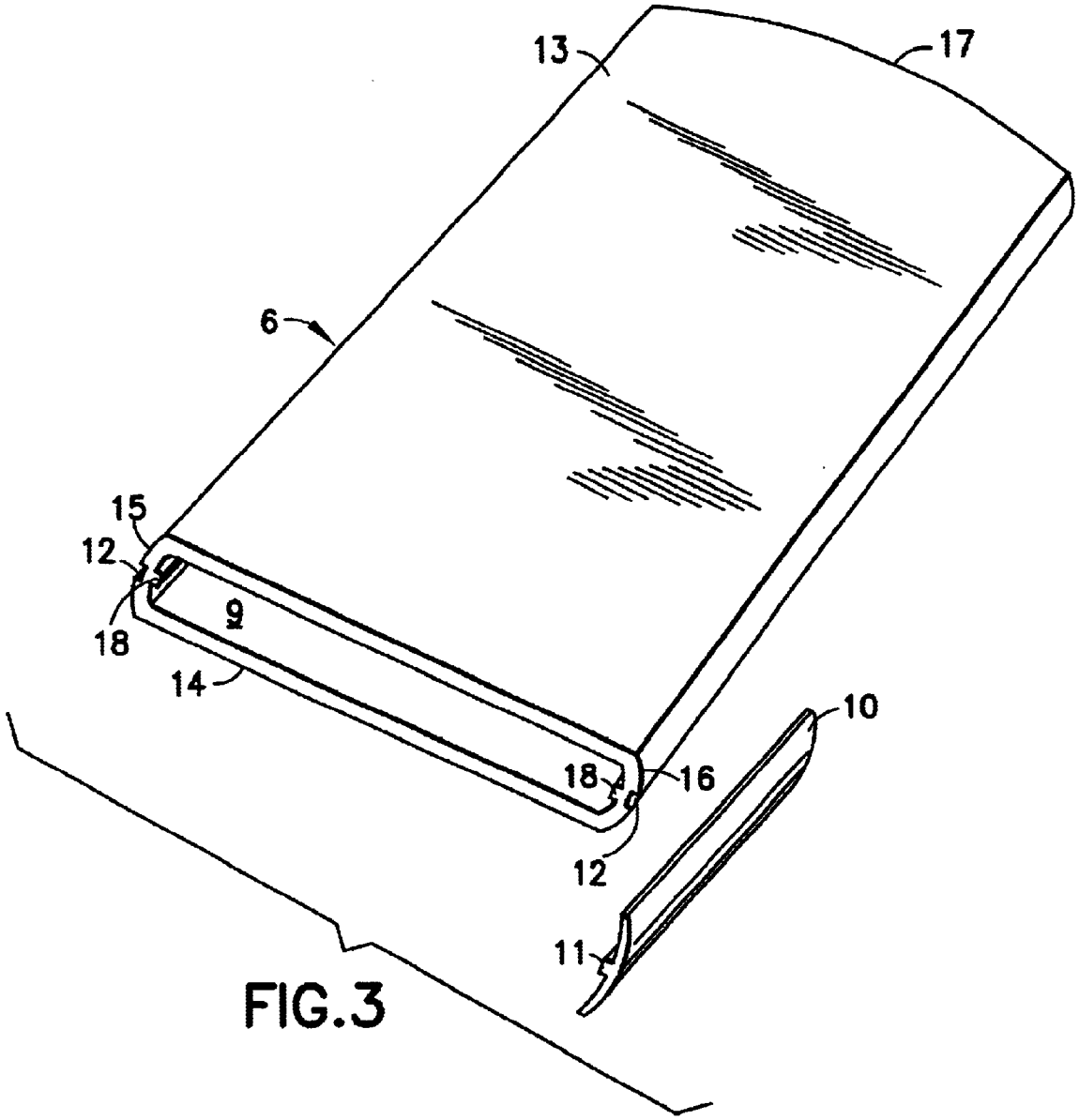
FIG. 3 shows a housing made by the process of this invention.

The method of this invention can be used to construct a wide variety of housing shapes, including exterior decorative covers and the like, for illustration a simple housing is shown in FIG. 3. The housing 6 is constructed with top and bottom panels 13 and 14 and side panels 15 and 16. One end of the housing is closed by a bottom panel 17. These panels form the housing 6 and enclose an interior chamber 9 which is designed to accommodate the working system of a mobile communication device (not shown).

Figure 1:
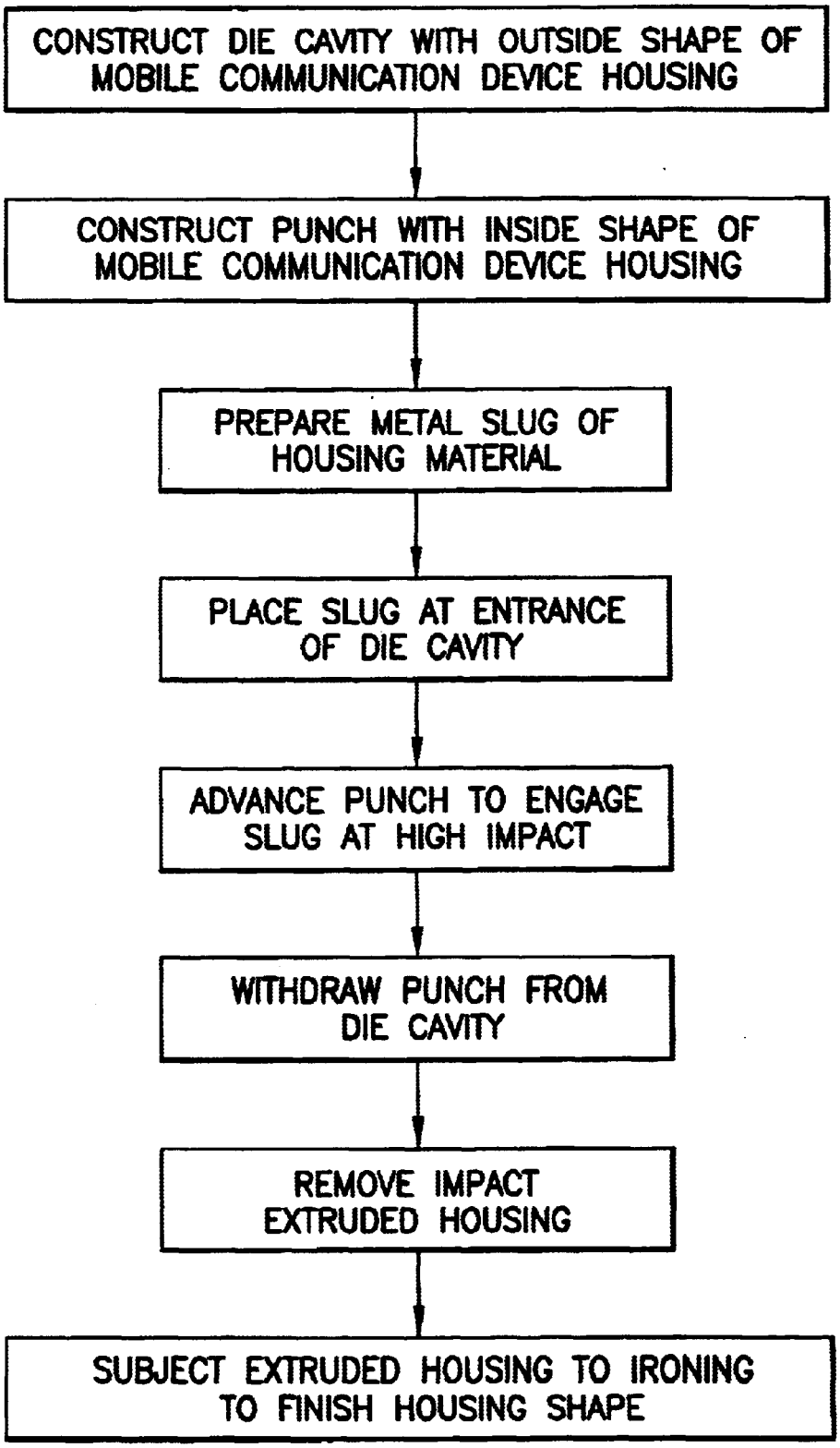
FIG. 1 is a diagram of the steps of this invention.
Figure 4:
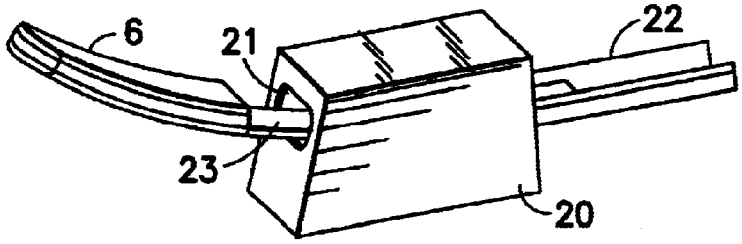
FIG. 4 is a schematic diagram showing apparatus used to perform an ironing step.

As illustrated in FIG. 1, the process of this invention requires the construction of a die element having a cavity with an interior shape of the exterior contours of the housing to be manufactured. A punch must also be constructed which is operatively matched to the die cavity and the interior of the housing of the mobile device. The die and punch are assembled in an impact extrusion machine (not shown) in an appropriate operative relation. A slug of material is positioned between punch and die. The material may be aluminum or selected from a variety of other materials such as for example, aluminum, zinc, gold, steel, magnesium, titanium, copper, and an assortment of alloys of these metals. To form the housing 6 the punch is rapidly advanced to engage the slug with sufficient impact to cause the metal slug to flow into the space between the punch and the die. After the punch is withdrawn, the extruded housing 6 is removed and subject to an ironing process in which the housing is cold worked by forcing the housing 6 through a shaping chamber to obtain the final housing shape. This step could be accomplished as shown in FIG. 4 in which the extruded housing is drawn through a drawing stone 20. The ironing apparatus may consist of drawing stone 20, fixture 22, and a mandrel 23. The cover or housing 6 is mounted on the mandrel 23 and drawn through the drawing chamber 21 of drawing stone 20 The ironing step could, for example, bend the housing to create a curved overall shape. To facilitate the assembly of the side grip panels, a pair of projections 7 and 8 are constructed extending into the sides of the die cavity 5. Such projections will form a groove in the exterior of the housing that accommodate a matching ridge 11 molded into the side panel 10 (see FIG. 3).

Figure 2A:
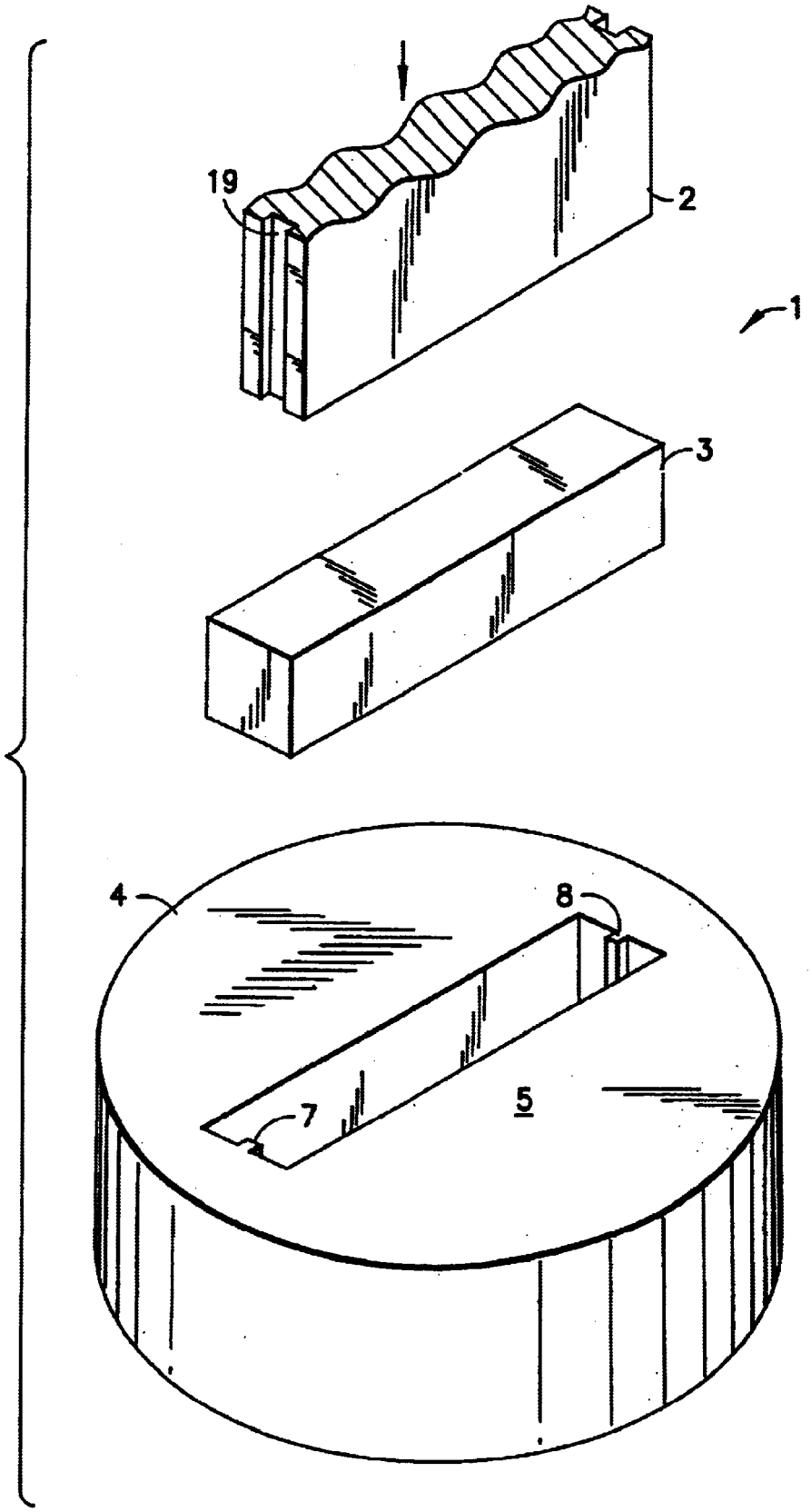
FIG. 2*a* is a schematic diagram of apparatus for performing the steps of this invention at the beginning of the process.
Figure 2B:
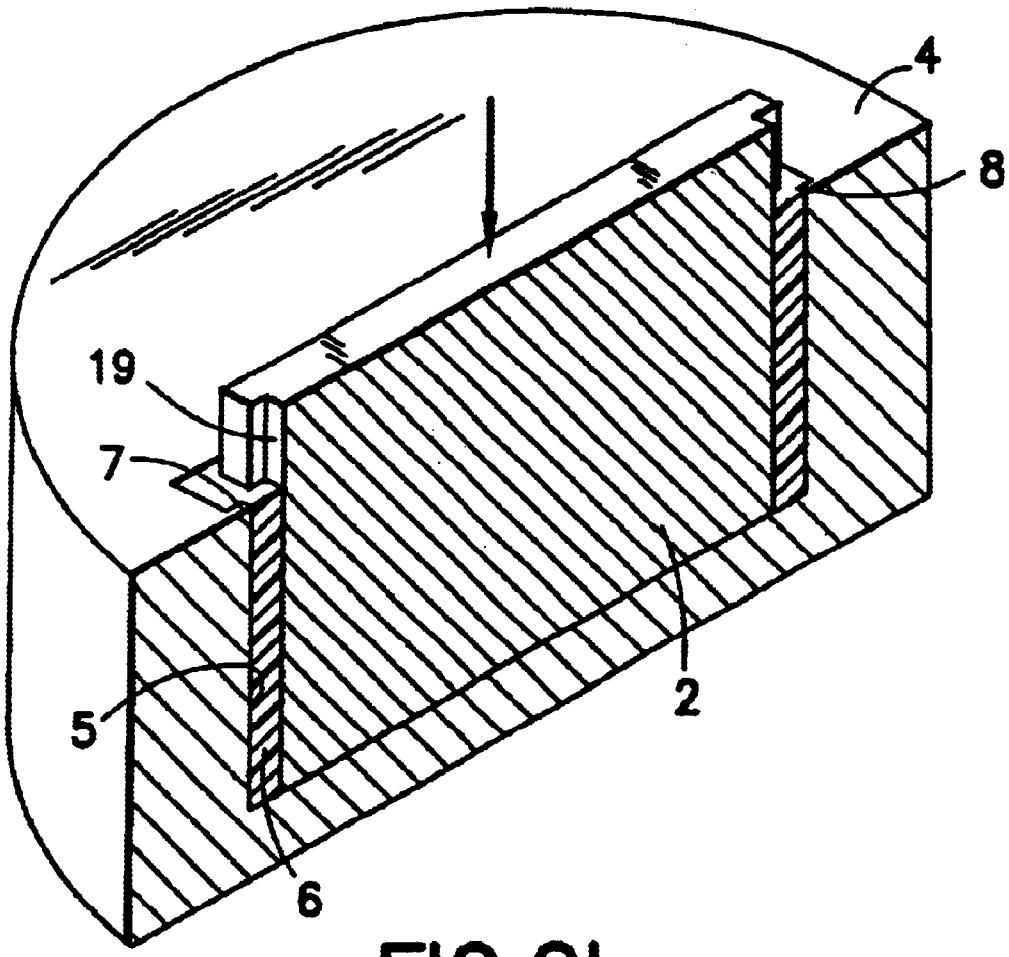
FIG. 2*b* is a schematic diagram of apparatus of FIG. 2*a* after the punch is advanced.

The impact extrusion assembly 1 is shown, prior to impact, in FIG. 2*a* and consists of a punch 2, a slug of metal 3, and die element 4. Punch 2 is connected to a ram which during operation advances the punch into the die element while impacting slug 3. The die cavity 5 formed within die element 4 may take a variety of shapes to accommodate the particular mobile device housing being manufactured. To obtain the features of the housing 6, as shown in FIG. 3, a pair of ridges 7 and 8 are constructed extending into the cavity 5. Such ridges will form a slot 12 in the side panels 15 and 16 of the housing 6 to receive grip panel 10 or other decorative or functional feature. By providing slots 19 extending the length of the periphery of the punch on opposite sides, ridges 18 may be formed, as shown in FIG. 3, on the interior of the housing 6. This is intended to be engaged with a mating slot molded into the periphery of a mobile communication device to provide a sliding engagement of the housing on the device.

A separate grip panel 10 is constructed for mounting to the side panels 15 and 16, as shown in FIG. 3. For ease of assembly a mating ridge 11 is molded into the grip panel for engagement with the grooves 12 extruded into the side panels 15 and 16 of the housing 6. The mating features could of course take different forms, the most obvious being the reverse of the groove and ridge configuration shown. Grip panels 10 are mounted on both side panels of the housing 6 and provide a secure gripping surface or could actuate a function of the device.

In this manner a process is provided which increases the efficiency of manufacturing housings for mobile communication devices.

We claim:

1. A method of constructing a housing for a mobile communication device, said housing having exterior walls which define an interior chamber, comprising the steps of:

constructing a die having an interior cavity that is shaped to provide the exterior profile of said exterior walls;

constructing a punch having an exterior profile which is shaped to provide the interior profile of said interior chamber, said punch designed to fit within said die cavity with a predetermined clearance;

preparing a slug of housing material having a predetermined volume and positioning said slug between the die and the punch;

advancing the punch to impact the slug and move it into said die cavity, said slug becoming plastic and flowing around said punch within said clearance;

withdrawing said punch;

removing said housing;

subjecting said housing to further forming to obtain final shape and finish, wherein said step of final shaping and finishing comprises cold working said housing by drawing said housing through a drawing chamber.

2. A housing for a mobile communication device constructed according to the method of claim 1.

3. The method of constructing a housing for a mobile communication device, according to claim 1, said housing having exterior walls which define an interior chamber, said method further comprising the step of forming ridges on the interior surface of the die to allow slots to form on the exterior of said housing to provide a mechanism for attaching at least one grip panel housing of said mobile communications device.

4. A housing for a mobile communication device constructed according to the method of claim 3.

5. A method of constructing a housing for a mobile communication device, said housing having exterior walls which define an interior chamber, comprising the steps of:

constructing a die having an interior cavity that is shaped to provide the exterior profile of said exterior walls;

constructing a punch having an exterior profile which is shaped to provide the interior profile of said interior chamber, said punch designed to fit within said die cavity with a predetermined clearance;

preparing a slug of housing material having a predetermined volume and positioning said slug between the die and the punch;

advancing the punch to impact the slug and move it into said die cavity, said slug becoming plastic and flowing around said punch within said clearance;

forming slots on the exterior surface of the punch to allow ridges to form on interior of said housing to provide a mechanism for attaching said housing to said mobile communications device;

subjecting said housing to further forming to obtain final shape and finish.

6. A housing for a mobile communication device constructed according to the method of claim 5.

* * * * *